US005769008A

United States Patent [19]

Finker et al.

[11] Patent Number: 5,769,008

[45] Date of Patent: Jun. 23, 1998

[54] LOW-EMISSION SWIRLING-TYPE FURNACE

[75] Inventors: Felix Zalmanovich Finker; Javad Berovich Akhmedov; Igor Borisovich Kubishkin, all of S.Petersburg, Russian Federation; Czeslaw Sobczuk; Jan Swirski, both of Warsaw, Poland; Mark Semenovich Glazman, Columbus, Ohio

[73] Assignee: Maloe Gosudarstvennoe Vnedrencheskoe Predpriyatie "Politekhenergo", Russian Federation

[21] Appl. No.: 700,525

[22] PCT Filed: Dec. 26, 1995

[86] PCT No.: PCT/RU95/00282

§ 371 Date: Aug. 28, 1996

§ 102(e) Date: Aug. 28, 1996

[87] PCT Pub. No.: WO96/21125

PCT Pub. Date: Jul. 11, 1996

[30] Foreign Application Priority Data

Dec. 29, 1994 [RU] Russian Federation ..... 94045164

[51] Int. Cl.[6] ..... F23G 5/00

[52] U.S. Cl. ..... 110/251; 110/346; 110/347; 110/105.6

[58] Field of Search ..... 110/346, 347, 110/251, 105.6

[56] References Cited

U.S. PATENT DOCUMENTS

| | | | |
|---|---|---|---|
| 4,246,853 | 1/1981 | Mehta | 110/347 |
| 4,308,806 | 1/1982 | Uemura et al. | 110/244 |
| 4,501,204 | 2/1985 | McCartney et al. | 110/264 |
| 4,655,148 | 4/1987 | Winship | 110/347 |
| 4,715,301 | 12/1987 | Bianca et al. | 110/347 |
| 4,854,249 | 8/1989 | Khinkis et al. | 110/342 |
| 4,993,332 | 2/1991 | Boross et al. | 110/347 |
| 5,199,357 | 4/1993 | Garcia-Mallol | 110/347 |
| 5,495,813 | 3/1996 | Chapman et al. | 110/341 |

*Primary Examiner*—Ira S. Lazarus
*Assistant Examiner*—Nhat-Hang H. Lam
*Attorney, Agent, or Firm*—Fay, Sharpe, Beall, Fagan, Minnich & McKee

[57] ABSTRACT

The low-emission swirling-type furnace is designed to burn organic fuel and it can be most advantegeously used for dust combustion.

A low-emission swirling-type furnace, according to the invention, comprises a combustion chamber (1) with a prismatic dry-bottom hopper (5) having a slot mouth, and an undergrate blast inlet means (7) disposed thereunder. The furnace includes at least one burner (2) formed by at least a pair of ducts (2*a*,2*b* ) lying one above the other and intended for supplying the air-fuel mixture. The ducts (2*a*, 2*b*) are each provided with a device (3, 4) for controlling the "air/fuel" ratio, ensuring such a ratio between the amount of air and the amount of fuel in each of the ducts (2*a*,2*b* ) that for the overlying duct (2*a*), this ratio turns out to be invariably higher than for the underlying duct (2*b*). The longitudinal axes of the ducts (2*a*, 2*b*) are preferably so inclined that the angle between the longitudinal axis of the duct (2*b*) and the projection of this axis onto the furnace wall for an underlying duct is less than that for the overlying duct (2*a*). Furthermore, the furnace may also be provided with a means (8) for supplying the fuel of a specific size composition into each duct.

During operating of such furnace, three functional zones are generated in the heating volume, namely: the ignition and active combustion zone, the reduction zone, and the reburning zone. This results in a reduced discharge of nitrogen oxides, along with an economical performance of the furnace.

16 Claims, 1 Drawing Sheet

LOW-EMISSION SWIRLING-TYPE FURNACE

FIELD OF THE INVENTION

The invention relates to heat engineering and more particularly, to furnaces for burning organic fuel, and it can be most successfully used for burning powdered fuel.

BACKGROUND OF THE INVENTION

When designing furnaces, a particular stress is laid on providing the complete combustion of the fuel, which is one of the determining factors for a more economical and environmentally oriented performance. The completeness of fuel combustion is known to be increased by a thorough intermixing of fuel and air and using a higher combustion temperature. An increased temperature in the burning zone, however, brings about an enhanced emission of nitrogen oxides due to formation of the so-called "thermal" nitrogen oxides as a result of air nitrogen oxidation. In addition, an increased flame temperature leads to slagging the heat-receiving furnace screens as well as to other negative results.

On the other hand, the reduction of the burning zone temperature by recirculating the combustion products, by a coarser grinding of the fuel, etc., will result in a less economical fuel combustion because of a sharp drop in the combustion reaction rate and consequently, a greater incompleteness of the fuel combustion.

The requirement for a complete fuel combustion also specifies the necessary amount of oxygen (air) supplied to the furnace. In order to burn a particular amount of fuel a strictly definite amount of oxygen is needed. In the case of its deficiency, incomplete burning of fuel occurs, with carbon monoxide formed in the process, with produces a detrimental effect on the environment. However, a considerable increase in the amount of air (oxygen) supplied is not desirable either, because in this case, there is an increased discharge into atmosphere of the excess air (oxygen) heated in the furnace, but not reacting with the fuel, which impairs the cost-effectiveness of the furnace and the entire boiler unit. Therefore, when designing the fuel combustion process, oxygen (air) is generally supplied with some excess.

In the majority of known solid fuel-fired furnaces, the excess-air coefficient is equel to 1.2, since this figure is most favorable in terms of cost-effectiveness. However, it is with such air (oxygen) excess that the maximum discharge of the fuel nitrogen oxides involved in oxidation of the nitrogen contained in the fuel is known to occur (cf. I. Ya. Sigal "Protection of Atmospheric Air from Contamination by Fuel Combustion Products", 1988, Nedra, Leningrad). The fuel nitrogen oxides are produced in the initial secton of the flame, where volatile components are released from the fuel (i.e. its thermal decomposition products).

According to present-day notions, a reduced nitrogen oxide concentration in the combustion products can be achieved by an optimized organization of three major zones in the flame, namely, zone of ignition and active combustion, zone of reduction, and zone of oxidation (reburning).

The ignition and active combustion zone is generally located in the vicinity of the burners. It is the bulk of the fuel that is ignited and burnt out in this zone. The reduction zone may be arranged in any part of the furnace chamber and is characterized by oxygen deficiency. Because of this, as the fuel interacts with the oxidizing agent (i.e. oxygen), partial combustion products (such as carbon monoxide) are formed in this zone, which interact with other oxides, including nitrogen oxides, depriving them of oxygen and reducing to molecular nitrogen. The oxidation zone may be located in any region of the furnace, provided it contains excess oxygen. The incomplete fuel combustion products coming from other zones are further oxidized in this area, for example, transforming the harmful carbon monoxide into a reletively safe carbon dioxide.

Known in the art is a furnace (see G. N. Levit "Pulverization at Heat-Electric Generation Plants", 1991, Energoatomizdat (Moscow), p.132, Fig. 7.2) comprising a vertical combustion chamber having burners for air-fuel mixture supply mounted on its walls. The burners are arranged in several tiers. The burners of each tier are connected with fuel preparation devices (mills) by means of pulverized-coal ducts, the burners of each individual tier being connected with a different mill, providing the air/fuel ratio control.

During operation of such furnace, the air-fuel mixture is supplied either through all of the burners or through part of them. The air/fuel ratio is chosen such that excess air is fed to the top-tier burners, and deficient air to the bottom-tier burners, resulting in an excess air coefficient of 1.2, which is the most economical value, as mentioned above. The bulk of the fuel is burnt within the ignition and active combustion zone adjacent the burners in the central portion of the combustion chamber. The combustion products rise up and are completely burned in the reburning zone, in the excess air supplied through the top-tier burners, and then carried away beyond the combustion chamber. Owing to the tier-wise arrangement of the burners, the combustion zone can be somewhat extended in the vertical plane, thereby increasing the fuel particle in-zone dwelling time and consequently ensuring more complete combustion of the fuel. In addition, a larger combustion zone leads to equalization of temperature fields within the zone and some reduction of the maximum combustion temperature, whereby the slagging of the furnace surface and formation of "air" nitrogen oxides (due to oxidation of air nitrogen at high temperatures) are prevented.

In such furnace, with the above arrangement of the burners, a certain optimization of the combustion zone locations and sizes can be achieved. So, for example, the size of the reduction zone in the furnace space is increased, thereby extending the time needed for the partial combustion products to interact with nitrogen compounds, which has been said to result in the reduction of nitrogen oxides. This is done by redistribution of "air-fuel" ratios between different burner tiers, in particular, so that a deficient amount of air is supplied to the bottom-tier burners to form the zone of reduction, while excess air is supplied to the top-tier burners to create a zone of reburning the partial combustion products. The small extention of the reburning zone causes a negligible oxidation of nitrogen.

As already mentioned above, with such arrangement of the burners the combustion zone temperature is somewhat reduced, leading to a sharp drop in the fuel burnout rate and consequently a lower output of the furnace. Furthermore, the relatively small size of the reburning zone in such furnace fails to provide the required completeness of fuel combustion, thus impairing the economic performance of the furnace.

In order to maintain the cost-effective operation of the furnace under conditions of the aforementioned decrease in the fuel burnout rate, one has to reduce the fuel particle size, again resulting in a higher maximum combustion temperature, which will lead to a less efficient suppression of nitrogen oxide generation and hence, to a greater probability of slagging the furnace surfaces.

There is another way of making up for a decrease in the fuel burning rate, while maintaining relatively low maximum combustion temperatures, namely: by extending the particle dwell time in the zones of active combustion and reduction This aim is attained in swirling-type furnaces.

Known in the art is a furnace (SU, A, 483559) comprising a combustion chamber with an air-fuel mixture supply burner mounted on its wall. The wall slopes of the lower part of the combustion chamber are made to define a V-type dry-bottom ash hopper with a slot-like mouth. Below the dry-bottom hopper is disposed an undergrate blast device such as an air nozzle.

During operation of such furnace, the air-fuel mixture is supplied through the burner, and air is fed from below, through the slot-like mouth, using the undergrate blast device. As a result of interaction between two opposite streams, a swirl zone is formed in the bottom part of the furnace and a direct-flow zone in the top part thereof. The fine particles of the fuel burn in the area adjacent the burners and in the direct-flow zone, while the medium-sized and course particles are separated into the swirl zone. In the swirl zone, these particles are burnt out in the process of recycling. After burning out down to a definite size, they are carried away from the swirl zone and completely burned in the upper, i.e. direct-flow, part of the flame. An intense intrafurnace recirculation of the "air-combustion products-fuel" mixture results in a substantial decrease and equalization of temperatures throughout the swirl zone. To prevent the bulk of the particles from burning in the vicinity of the burners and to benefit most from the swirling-type furnaces, a variety of techniques are employed in such furnaces, for example, the use of a coarser particle-sized fuel with the relatively low fine-particle content, the downward tilting of the burners and increasing the air-flow rate therein for better separation of the fuel particles off to the swirl zone. The reduced fuel combustion rate caused by lower maximum combustion temperatures and by the larger-sized fuel particles is balanced out by an extended time of the fuel dwelling within the low-temperature area, i.e. in the swirl zone. At the same time, a substantial part of the swirl zone is occupied by the zone of reduction known for its deficiency in oxygen. This enables the discharge of nitrogen oxides to be minimized, as a result of their reduction.

The field tests of a boiler incorporating such furnace have confirmed a substantial decrease in the temperature level and a sharp drop in the nitrogen oxide concentration in the exit gases. In such furnace, however, as mentioned hereinbefore, the bulk of the burning fuel circulates within the swirl zone, whereas in the direct-flow zone containing excess oxygen and acting as a reburning zone, the temperature proves to be still lower than in the swirl zone, because of the small quantity of the burning fuel. Therefore, the fuel particles carried away from the swirl zone, largely, do not have enough time to burn out in the direct flow portion of the flame. The heat losses due to mechanical incompleteness of fuel combustion in such furnace are generally above the normative values, resulting in a comparatively poor cost-effectiveness of the furnace.

DISCLOSURE OF THE INVENTION

It is the object of the present invention to provide a swirling-type furnace such that it allows a repeated circulation of fuel particles in the low-temperature reduction zone and simulteneous reburning of fine-grained coke particles in the high-temperature oxygenated zone, thereby reducing the discharge of nitrogen oxides and resulting in a more cost-effective furnace.

With this object in view, in a swirling-type furnace comprising a combustion chamber with at least one downward-titled air-fuel mixture supply burner mounted on its wall, a prism-shaped dry-bottom hopper having a slot-like mouth defined by the wall slopes of the bottom part of the combustion chamber, and an undergrate blast inlet device located below the dry-bottom hopper mouth, according to the invention, the width of the outlet nozzle of the undergrate blast device is equal to that of the dry-bottom hopper slot-like mouth, the burner is formed by at least two ducts for air-fuel mixture supply, lying one above other, and each of the ducts is provided with a device for controlling the air/fuel ratio, said devices being so designed that the air-to-fuel ratio in the upper duct invariably exceeds that of the lower duct.

During operaton of such furnace, an air-fuel mixture is supplied through both of the burner ducts, and air is supplied from beneath, through the undergrate blast inlet, over the entire width of the dry-bottom hopper mouth. Because each of ducts is provided with a means for controlling the air/fuel ratio, and these means ensure the above air-to-fuel ratio in each of the ducts, an excessive amount of oxygen finds its way to the upper portion of the combustion chamber, when this zone is sufficiently loaded with fuel particles coming from the overlying burner duct, causing thereby a relatively high combustion temperature with excess oxygen in this zone and consequently, an efficient fuel reburning. The charging of fuel into the middle portion of the furnace is preferably done from the underlying duct with a deficient amount of oxygen.

As a result of interaction between the air-fuel mixture flow out of the duct and the air fed from the undergrate blast inlet means across the width of the dry-bottom hopper mouth, a swirl zone is created, whose major part is characterized by an oxygen deficiency and a relatively low maximum temperature, serving as the reduction zone, and the peripheral part which is adjacent the wall receiving the undergrate blast air shows an excess of oxygen and serves as the oxidation zone.

By virtue of recirculation, the bulk of medium-sized fuel particles are burnt in the swirl zone, a nitrogen-oxide reduction process simulteneously occuring in this zone because of the oxygen deficiency. The large-sized fuel particles from both of the burner ducts are separated into the lower part of the furnace, picked up by the ascening air current and carried again into the swirl zone near the burner, and so forth, until the fuel particles are completely burnt out.

The burner ducts are preferably so arranged that the angle formed by the longitudinal axis of any duct and the projection of this axis on to the respective wall of the combustion chamber is less, than the corresponding angle for the overlying duct.

With the ducts so inclined relative to the wall, there is provided a vertical extension of the reduction zone and consequently, a longer time for the burning particles to stay in the low-temperature zone, resulting in a more complete combustion of the fuel and reduction of nitrogen oxides. Further, it permits a vertical separation of the zones performing different functions, i.e. the reduction and the oxidation zone, enabling the air/fuel ratio for each duct to be selected more accurately, in order to provide the optimized modes of furnace operation. In addition, such sloping of the burner ducts provides a still more effective charging of the fuel into both the upper and the central part of the combustion chamber and hence, a higher furnace output.

It is preferred that the furnace be provided with a means, such as the dust concentrator, for supplying the fuel of a specified size composition to each of the ducts. In this case, a predominantly fine-grained fuel should be fed to the overlying duct so that it has time to burn in the neighborhood of this duct, ensuring the required temperature level, whereas the underlying duct should receive a coarser-grained fuel which burns succesfully in the swirl zone.

BRIEF DESCRIPTION OF THE DRAWING

The invention is further illustrated by a detailed description of the preferred embodiment with reference to the accompanying drawing in which.

PREFERRED EMBODIMENT OF THE INVENTION

Figure 1:
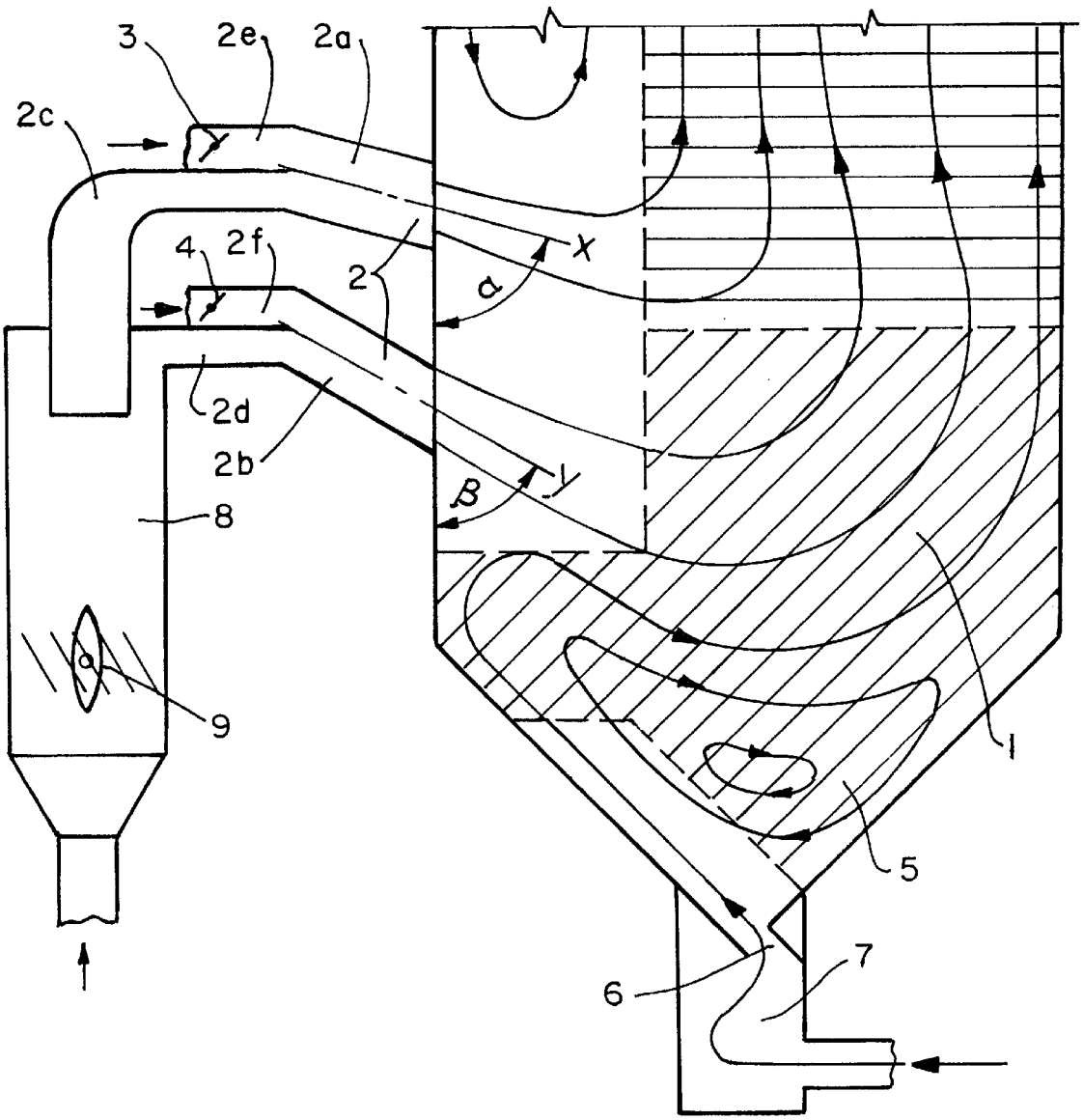
FIG. 1 is a longitudinal section of a swirling-type furnace, according to the invention.

With reference to FIG. 1, the swirling-type furnace, according to the invention, comprises an upright combustion chamber 1 with a burner 2 for air-fuel mixture supply mounted on its front wall. The burner 2 is formed by a pair of ducts 2*a* and 2*b* includes for supplying the fuel-air mixture. The duct 2*a* includes a branch pipe 2*c*, and the duct 2*b* includes a branch pipe 2*d* for supplying the fuel mixture. Further, the duct 2*a* includes a branch pipe 2*e*, and the duct 2*b* includes a branch pipe 2*f* for supplying air. In order to control the air/fuel ratio, each of the branch pipes 2*e*, 2*f* is provided with a device preferably formed by, gates 3 and 4 fitted in the branch pipes 2*e*, 2*f*, respectively. In addition, the cross-sectional areas of the branch pipes 2*c* and 2*d* and of the branch pipes 2*e* and 2*f*, as well as the controlling range for the gates 3 and 4, are chosen such that in any position of the gates, the air-to-fuel ratio for the duct 2*a* exceeds that for the duct 2*b*. The furnace of the invention may also include a larger number of ducts. In this case, their mechanical design is similar to that described above. Both the front and the rear wall of the combustion chamber are inclined at bottom end of the combustion chamber and combine with their side walls to form a prismatic dry-bottom hopper 5 with a slot-like mouth 6. Disposed beneath the mouth 6 of the dry-bottom hopper 5 is an undergrate blast inlet means 7. As shown in FIG. 1, the angle $\alpha$ made by the longitudinal axis X of the duct 2*a* with the projection of this longitudinal axis X on to the wall of the combustion chamber I is greater than the angle $\beta$ made by the longitudinal axis Y of the duct 2*b* with the projection of this axis on to the wall of the combustion chamber 1. It will be noted that the "fuel" nitrogen oxides are largely produced in the initial portion of the flame. Therefore, depending on the kind of fuel and the features of the specific furnaces, the mutual arrangement of the duct axes must be such as to allow separation, across the height, of the zones with different functions—reduction and oxidation—and to make the choice of the air-fuel ratio for each of the ducts as precise as possible. The air-fuel mixture flows coming out of the ducts 2*a* and 2*b* diverge, as they move away from the mouths. The aperture is generally about 7 degrees. Therefore, for most of the fuels and furnace chamber types employed, the angles between the longitudinal axes of the ducts 2*a* and 2*b* are generally from 12 to 15 degrees. The furnace is also equipped with a device for supplying the fuel of a specified size composition to each duct, which device is implemented in the form of a dust concentrator 8 with a swirler 9. Any concentrator out of those generally employed in heat engineering may be used here, as well as other known devices intended for the purpose. The fuel of a specified size composition may also be supplied to each duct by means of mills, as was the case in the aforementioned known device.

The operating of the swirling-type furnace now follows.

An air-fuel mixture is supplied to the dust-concentrator 8. The swirler 9 swirls the stream, causing the fuel to be size-separated by a centrifugal force,namely: the coarser fuel particles are forced against the walls of the dust concentrator 8 and are fed, largely, to the branch pipe 2*d*,while the finer (less inertial) particles of the fuel are raised along with the air current and received by the branch pipe 2*c*. So the relatively finer fuel particles are fed to the upper duct 2*a* and the relatively coarser fuel particles to the lower duct 2*b*. The amounts of the fuel supplied to the upper and lower ducts are dependent on the dust concentrator design and are preset according to the type of fuel and the boiler furnace chamber design. The amount of fine-grained fuel supplied to the upper duct must be such as to provide the required temperature level in the vicinity of the upper duct. At the same time, air is supplied through the branch pipes 2*e* and 2*f*, controlling its flow rate by means of the gates 3 and 4, respectively, so that more air is supplied to the upper duct 2*a* and less to the lower duct 2*b*. In addition, air is supplied simulteneously by the undergrate blast means 7 through the slot mouth 6. As a result of interaction between the air-fuel mixture flows coming to the furnace from the ducts 2*a* and 2*b* and the counterflow from the undergrate blast means, a vortex gas flow is generated in the lower part of the furnace. The air-fuel mixture flows coming from the ducts 2*a* and 2*b* diverge, as they move away from the mouths of the ducts, expanding and filling the heating space with the fuel mixture.

By virtue of the longitudinal axes of the ducts 2*a* and 2*b* being inclined at different angles to the walls of the combustion chamber 1, the angle $\alpha$ of slope of the longitudinal axis X of the duct 2*a* exceeding the angle $\beta$ of slope of the longitudinal axis Y of the duct 2*b*, substantially the whole furnace volume of the combustion chamber is filled with the fuel mixture uniformly over the height thereof. If the furnace accommodates a larger number of ducts, a still more effective filling of the heating space with the air-fuel mixture is possible. Relatively finer fuel particles are burnt near the mouth of the ducts 2*a* and 2*b*. It is in this region that the ignition and active combustion zone is generated. The bulk of the finer fuel particles are ignited and burnt in this zone.

In FIG. 1, the ignition and active combustion zone is shown unatched. Adjacent the upper duct 2*a*,with excess oxygen supplied through the branch pipe 2*e*, the combustion takes place at the comparatively high temperature, the "fuel" nitrogen oxides being produced in the process. However, as the smaller portion is supplied through this duct, the amount of resulting nitrogen oxides is rather insignificant. On the other hand, the larger portion of the fuel enters the furnace through the duct 2*b*, part of the fuel, namely, the finest particles, being burnt near the burners in the ignition and active combustion zone there existing.

The functioning of this zone is maintained both by the small quantity of air supplied from the duct 2*b* and by the undergrate blast air supplied through the slot mouth of the dry bottom hopper, along the slope, to find its way under the duct 2*b*. The remaining (unburnt) fuel is separated into the swirl zone in the central part of the furnace, and as the slope $\beta$ of the longitudinal axis Y of the lower duct is smaller than the slope $\alpha$ of the X axis of the upper duct, the swirl zone proves to be very much extended in a vertical plane. This results in a reduced maximum combustion temperature, equalized temperature fields and a vast reduction zone generated under oxygen deficiency conditions.

In addition to providing the necessary amount of oxygen in the furnace volume, the undergrate blast device performs another important function: return into the swirl zone of all the fuel particles that had been separated into the lower part of the furnace chamber. This is done by providing that the outlet nozzle of the undergrate blast device is equal in width to the slot mouth 6 of the dry-bottom hopper 5, thus preventing the fall-through of some fuel particles. These factors are largely responsible for the resultant high economic and environmental performance of the furnace.

In FIG. 1, the reduction zone is indicated by slanted hatches. When the fuel is burnt with oxygen deficiency and at relatively low temperatures, there is produced a certain amount of nitrogen oxides and incomplete combustion products. However, because of the presence of a vortex flow and a relatively large-sized reduction zone, and as these products stay in the reduction zone for a long time, the incomplete combustion products, such as carbon oxides, interact with other oxides, such as nitrogen oxides.

As a consequence, the carbon monoxide takes up oxygen from the nitrogen oxide, reducing it to molecular nitrogen. At the same time, the poisonous carbon monoxide is changed to a relatively harmless dioxide. The unburnt fuel particles left over after the reduction zone are predominantly carbon (coke) particles that are essentially nitrogen-free.

Coke and gaseous products of incomplete combustion at the outlet from the swirl zone are introduced into the air-fuel mixture flow from the upper duct which exhibits an excess air content and creates the reburning zone indicated in FIG. 1 by a horizontally hatched area. Since, as it was mentioned hereinbefore, the reburning zone receives from the overlying duct the amount of fine-grained fuel which provides, in the process of combustion, a high temperature in this zone, a relatively complete reburning of solid and gaseous partial-combustion products occurs.

In case the furnace includes more ducts than the above design, a still more efficient fillings of the heating volume with the air-fuel mixture can be achieved, providing a more complete fuel combustion.

Thus, among the distinctive features of the proposed furnace is recirculation of fuel particles in the low-temperature reduction zone and simultaneous reburning of fine-grained particles carried away from the swirl zone in the high temperature, oxygenated, zone. This causes a reduced discharge of nitrigen oxides. At the same time, owing to a vortex flow present in the furnace, and by making the outlet window of the undergrate blast device as wide as the mouth of the dry-bottom hopper, a relatively complete combustion of the fuel is ensured, with the consequent cost-effectiveness of the furnace.

Industrial Application

The proposed invention was implemented in an attempt to modernize the furnace of an industrial boiler using coal dust as the fuel. The furnace had four burners, one on each wall thereof. The burners each are formed by a pair of ducts lying one above the other. The angle made by the longitudinal axis of the upper duct of each burner with the projection of this axis on to the vertical wall of the combustion chamber was 75 deg., and the angle made by the longitudinal axis of the lower duct of each burner with the projection of this axis on to the vertical wall of the combustion chamber was 55 deg. Fuel characterized by a sieve residue of 200 $\mu$m $R_{200}$=3 . . . 5% was supplied to the upper ducts, whereas to the lower ducts was supplied fuel with a sieve residue of 200 $\mu$m $R_{200}$=20 . . . 25% After modernization, the amount of nitrogen discharged was reduced by 35 . . . 40%.

We claim:

1. A low-emission swirling-type furnace comprising:

a combustion chamber including a prismatic dry-bottom hopper having a slot-like mouth defined by walls of a bottom part of the combustion chamber;

an undergrate blast inlet means disposed beneath the mouth of the dry-bottom hopper; and, at least one downward-tilted burner for supplying an air-fuel mixture into said combustion chamber, the burner being formed by at least two ducts lying one above the other, for supplying the air-fuel mixture into the combustion chamber, each of the ducts being provided with an air/fuel ratio control device for controlling a ratio of air to fuel in each of said at least two ducts, said air/fuel mixture control devices cooperatively controlling a first ratio between an amount of air and an amount of fuel for a first overlying duct to be higher than a second ratio between an amount of air and an amount of fuel for a second underlying duct.

2. A low-emission swirling-type furnace according to claim 1 wherein:

a first angle between a first longitudinal axis of said first duct of the at least two ducts and a projection of the first longitudinal axis onto a first wall of the combustion chamber is greater than a second angle between a second longitudinal axis of said second duct underlying said first duct and the projection of the second longitudinal axis onto the respective wall of the combustion chamber.

3. A low-emission swirling-type furnace according to claim 2 further comprising a fuel supply means for supplying fuel of a predetermined specified size composition into each of said at least two ducts.

4. A low-emission swirling-type furnace according to claim 1 further comprising a fuel supply means for supplying fuel of a predetermined specified size composition into each of said at least two ducts.

5. A low-emission swirling-type furnace according to claim 4 wherein said fuel supply means is adapted to deliver fine fuel particles said first duct and course fuel particles to said second duct.

6. A low-emission swirling-type furnace according to claim 1 wherein said at least one downwardly-tilted burner includes a plurality of ducts for supplying said air-fuel mixture into said combustion chamber.

7. A low-emission swirling-type furnace according to claim 6 further comprising a plurality of air/fuel ratio control devices, each one of said plurality of air/fuel ratio control devices being operatively associated with a one of said plurality of ducts for conreolling an air to fuel ratio in said respective one duct.

8. A low-emission swirling-type furnace according to claim 7 wherein said plurality of air/fuel ratio control devices are operative to control an air to fuel ratio in ducts closest to said undergrate blast inlet means to be greater that an air to fuel ratio in ducts further away from said the undergrate blast inlet means.

9. A swirl type furnace simultaneously recirculating fuel particles in a low-temperature reduction zone and reburning fine-grained unburned fuel particles in a high temperature oxidation zone, the swirl type furnace comprising:

a combustion chamber having a front wall, a rear wall and a pair of side walls, the front and rear walls being inclined at a bottom end of the combustion chamber to define, together with said pair of side walls, a prismatic dry-bottom hopper in the bottom end of the combustion chamber;

a slot-like mouth defined in the prismatic dry-bottom hopper at the bottom end of the combustion chamber;

a first duct on said front wall introducing a first air/fuel particle mixture flow into said combustion chamber along a first longitudinal axis defined by said first duct;

a second duct on said front wall introducing a second air/fuel particle mixture flow into said combustion chamber along a second longitudinal axis defined by said second duct;

an undergrate blast means at the slot-like mouth introducing a counterflow of air directed at said front wall, the counterflow of air mixing with the first and second air/fuel particle mixture flows to form a vortex gas flow, the undergrate blast means and the first and second ducts collectively being adapted to develop reduction and oxidation zones in said combustion chamber and generate said vortex gas flow for repeatedly circulating fuel particles in said reduction zone.

10. The swirl type furnace according to claim 9 wherein:

the undergrate blast means and the first and second ducts are adapted to develop said reduction zone in said combustion chamber and generate said vortex gas flow by an interaction of i) the first air/fuel particle mixture flow, ii) the second air/fuel particle mixture flow, and iii) said counterflow of air.

11. The swirl type furnace according to claim 10 wherein:

the first longitudinal axis defined by the first duct forms a first angle with the front wall of the combustion chamber; and, the second longitudinal axis defined by the second duct forms a second angle with the front wall of the combustion chamber, the first angle being different from the second angle.

12. The swirl type furnace according to claim 9 wherein:

the first angle is greater than said second angle; and, said second duct is disposed on the front wall of the combustion chamber between the first duct and the undergrate blast means.

13. A swirl type furnace simultaneously recirculating fuel particles in a low-temperature reduction zone and reburning fine-grained unburned fuel particles in a high temperature oxidation zone, the swirl type furnace comprising:

a combustion chamber having a front wall, a rear wall and a pair of side walls, the front and rear walls being inclined at a bottom end of the combustion chamber to define, together with said pair of side walls, a prismatic dry-bottom hopper in the bottom end of the combustion chamber;

a slot-like mouth defined in the prismatic dry-bottom hopper at the bottom end of the combustion chamber;

a plurality of ducts on said front wall in a linear array, said plurality of ducts introducing a plurality of air/fuel particle mixture flows into said combustion chamber along a plurality of longitudinal axes defined by said plurality of ducts;

an undergrate blast means at the slot-like mouth introducing a counterflow of air directed at said front wall, the counterflow of air mixing with said plurality of air/fuel particle mixture flows to form a vortex gas flow, the undergrate blast means and the plurality of ducts collectively being adapted to develop reduction and oxidation zones in said combustion chamber and generate said vortex gas flow for repeatedly circulating fuel particles in said reduction zone.

14. The swirl type furnace according to claim 13 wherein:

the undergrate blast means and the plurality of ducts are adapted to develop said reduction zone in said combustion chamber and generate said vortex gas flow by an interaction of said plurality of air/fuel particle mixture flows and said counterflow of air.

15. The swirl type furnace according to claim 13 wherein:

said plurality of longitudinal axes defined by said plurality of ducts form a plurality of angles with the front wall of the combustion chamber, each of said plurality of angles being different from one another.

16. The swirl type furnace according to claim 13 wherein:

the plurality of angles formed by said plurality of longitudinal axes vary to successively increase in magnitude for ducts positioned successively further away from said undergraste blast means.

* * * * *